US010813516B2

(12) United States Patent
Reccanello

(10) Patent No.: US 10,813,516 B2
(45) Date of Patent: Oct. 27, 2020

(54) SURFACE TREATMENT MACHINE WITH SPEED CONTROL

(71) Applicant: IP CLEANING S.R.L., Portogruaro (IT)

(72) Inventor: Francesco Reccanello, Padua (IT)

(73) Assignee: IP CLEANING S.R.L., Portogruaro (IT)

( * ) Notice: Subject to any disclaimer, the term of this patent is extended or adjusted under 35 U.S.C. 154(b) by 257 days.

(21) Appl. No.: 15/756,439

(22) PCT Filed: Sep. 2, 2016

(86) PCT No.: PCT/IB2016/055268
§ 371 (c)(1),
(2) Date: Feb. 28, 2018

(87) PCT Pub. No.: WO2017/037669
PCT Pub. Date: Mar. 9, 2017

(65) Prior Publication Data

US 2019/0021569 A1 Jan. 24, 2019

(30) Foreign Application Priority Data

Sep. 2, 2015 (IT) ..... 102015000047898

(51) Int. Cl.
*A47L 11/00* (2006.01)
*B08B 1/00* (2006.01)
(Continued)

(52) U.S. Cl.
CPC ..... *A47L 11/4011* (2013.01); *A47L 11/282* (2013.01); *A47L 11/30* (2013.01);
(Continued)

(58) Field of Classification Search
CPC ..... A47L 11/4011; A47L 11/4066; A47L 11/4008; A47L 11/30; A47L 11/282;
(Continued)

(56) References Cited

U.S. PATENT DOCUMENTS 5,735,959 A * 4/1998 Kubo ..... A47L 11/03 118/244
6,163,915 A * 12/2000 Kaczmarz ..... A47L 11/283 15/320
(Continued)

FOREIGN PATENT DOCUMENTS

WO WO 2010/099968 A2 9/2010

*Primary Examiner* — Alexander Markoff
(74) *Attorney, Agent, or Firm* — Stein IP, LLC

(57) ABSTRACT

A surface treatment machine, comprising a frame configured to translate with respect to a surface to treat, a surface treatment element connected to said frame and configured to treat with liquid a surface, a reservoir connected to the frame arranged to provide liquid to the surface treatment element through a delivery mouth; an adjustment element arranged to feed adjustably the liquid supplied from the reservoir to the delivery mouth. It is then provided a sensor configured to measure the speed of the frame with respect to the surface to treat. A control unit receives from the sensor a signal proportional to a speed for adjusting the adjustment element responsive to this value, in order to deliver the liquid with optimization of the flow-rate. It is possible then to maximize the range of the machine, and to optimize the working time of the operator.

5 Claims, 5 Drawing Sheets

(51) Int. Cl.

| | |
|---|---|
| ***B08B 3/04*** | (2006.01) |
| ***A47L 11/282*** | (2006.01) |
| ***B05C 11/10*** | (2006.01) |
| ***A47L 11/40*** | (2006.01) |
| ***A47L 11/30*** | (2006.01) |

(52) U.S. Cl.
CPC ..... *A47L 11/4008* (2013.01); *A47L 11/4066* (2013.01); *A47L 11/4083* (2013.01); *A47L 11/4088* (2013.01); *B05C 11/10* (2013.01); *B08B 1/001* (2013.01); *B08B 3/04* (2013.01); *A47L 2601/02* (2013.01)

(58) Field of Classification Search
CPC ..... A47L 11/4083; A47L 11/4088; A47L 2601/02; B05C 11/10; B08B 1/001; B08B 3/04
See application file for complete search history.

(56) References Cited

U.S. PATENT DOCUMENTS

| | | | | |
|---|---|---|---|---|
| 8,551,262 | B2 | 10/2013 | Eklund et al. | 134/36 |
| 9,725,013 | B2 * | 8/2017 | Romanov | A47L 11/4011 |
| 2002/0148068 | A1 * | 10/2002 | Legatt | A47L 11/30 15/340.1 |
| 2003/0019070 | A1 | 1/2003 | Field et al. | 15/320 |
| 2004/0221415 | A1 | 11/2004 | Tondra et al. | 15/320 |
| 2018/0242809 | A1 * | 8/2018 | Reccanello | A47L 11/03 |
| 2018/0249876 | A1 * | 9/2018 | Reccanello | A47L 11/30 |
| 2018/0249879 | A1 * | 9/2018 | Reccanello | A47L 11/30 |

* cited by examiner

SURFACE TREATMENT MACHINE WITH SPEED CONTROL

CROSS-REFERENCE TO RELATED APPLICATIONS

This application is a national stage of International Application No. PCT/IB2016/055268 filed Sep. 2, 2016, which claims the benefit of Italian Application No. 102015000047898, filed Sep. 2, 2015, in the Italian Patent Office, the disclosures of which are incorporated herein in their entireties by reference.

FIELD OF THE INVENTION

The present invention relates to surface treatment machines of the type having a surface treatment element configured to treat a surface with liquid.

Among such machines there are comprised both those of ride-on type and of walk-behind type, which can be either motorized or pushed, with a surface treatment element in the form of either a brush, disc, pad, spraying member.

DESCRIPTION OF THE PRIOR ART

Machines exist for treating surfaces with liquid that provide the application of the liquid by means of a treatment element, taking the liquid from a reservoir on board of the machine.

Once ended the liquid, the operator has to bring the machine to a point of replenishment, for filling again the reservoir.

In some cases the dirty liquid is collected from the surface by the machine, for example by a suction system, which is arranged to drain the liquid by suction up to a collection container on board of the machine. When the reservoir is emptied also the collection container is normally full, because the latter is sized according to the capacity of the reservoir.

The operators of such surface treatment machines, in case they have to cover wide surfaces, like the case for example of overnight cleaning of places like airports, hospitals, schools, offices, etc., have often the problem of not knowing, unless in very rough approximation, the amount of residual liquid in the reservoir, and then the range of the machine in terms of amount of surface that can be treated before making again a replenishment of liquid.

A precise knowledge of the range of the machine is desirable, because it would allow planning an optimal treatment route up to the nearest replenishment point before the treatment liquid ends.

In WO2010/099968A2 a machine for cleaning surfaces is described that provides a system for automatically calculating the range of the machine. It carries out a measurement of physical and kinematical quantities, in particular the speed of the machine, from which the ratio is calculated between the cleaned surface and the time necessary to clean it, responsive to many parameters indicated by the operator, like the size of the brush or the size of the nozzle for soaking the brush. The operator, by knowing the residual range of the machine, has a useful information for completing the route up to the next replenishment.

In the surface treatment machines with liquid treatment, it can occur that the delivery of liquid to the surface treatment element is not constant, and this does not permit to calculate precisely the range of the machine, with an easy knowledge of physical and kinematical quantities, as space, time, speed.

For example, in case of feeding the liquid by gravity, as the reservoir is progressively emptied the flow-rate of liquid to the treatment element changes. Even in case of feeding the liquid by means of a pump not of positive displacement type, which however would be heavier and expensive, the flow-rate of liquid to the surface treatment element can change, owing to leakages and to sensitivity of the pump at the supply pressure. The operator, then, in order ensure an effective treatment, i.e. with a sufficient amount of liquid versus treated surface, adjusts the opening value of the feeding duct section in such a way to ensure always an amount of liquid vis-a-vis treated surface that is enough for treatment, even in the most unfavorable situations. This determines, however, owing to unsteadiness of the flow-rate, a reduction of the range of the machine.

Furthermore, changing the speed of the surface treatment machines with respect to the surface to treat, there is a subsequent change of the amount of supplied liquid versus treated surface, and also this requires an adjustment of the feeding duct section, in order to ensure an amount of liquid that is sufficient also in case of maximum speed of the machine, with the consequence of reducing the range of the machine.

In U.S. Pat. No. 8,551,262 a chemical detergent is dosed with respect to water, taking into account the level in the water reservoir. A level sensor provides a signal of level that influences a controller of a positive displacement pump which feeds the chemical detergent. This way, the dilution in water of the chemical detergent is kept fixed regardless of the level of water in the reservoir.

US2004221415 describes a surface treatment machine with a reservoir that provides a cleaning solution to a distributor and a device for detecting the speed of the machine along the surfaces, arranged to provide a speed signal. A controller, operatively connected to the detection device and to a component of the treatment machine, controls the operation thereof responsively to the speed signal.

US2003019070 describes a surface treatment machine with a reservoir, an delivery mouth of chemical detergent, a pump and a flow control device, which delivers a flow-rate independent from the volume of feeding detergent. The output of the pump is adjusted responsively to the speed of the machine with respect to the surface to clean.

SUMMARY OF THE INVENTION

It is a feature of the present invention to provide a surface treatment machine that ensures an effective treatment concerning the amount of liquid versus treated surface and in the meantime maximizes the range of the machine.

It is another feature of the invention to provide such a machine which permits controlling the delivery of liquid to the surface treatment element versus the level of liquid present in the reservoir for improving the range of the machine.

It is another feature of the invention to provide such a machine for maximizing the range of the machine responsive to a predetermined cleaning route.

It is also a feature of the present invention to provide such a machine that enables an operator to determine in real time the residual range of the machine.

These and other objects are achieved by a surface treatment machine, comprising:

a frame configured to translate with respect to a surface to treat, a surface treatment element connected to the frame and configured to treat with liquid a surface with respect to which the frame advances, a reservoir connected to the frame and arranged to supply a liquid to the surface treatment element through a delivery mouth;

an adjustment element arranged to feed adjustably the liquid supplied from the reservoir to the delivery mouth;

a sensor configured to measure the translation speed of the frame with respect to the surface to treat and to provide a signal proportional to this speed;

a control unit configured to receive from the sensor said signal proportional to the speed, program means, resident in said control unit and configured to set the adjustment element so that a flow-rate of liquid is supplied in an increasing way responsive to an increase of said speed optimizing the flow-rate, in order to achieve a maximum range of the machine.

The adjustment element can be selected from the group consisting of:

a piloted valve, where the control unit is configured to adjust an opening rate of the valve in an increasing way responsive to an increase of the speed;

a pump, where the control unit is configured to adjust the speed of the pump in an increasing way responsive to an increase of the speed;

wherein said control unit is associated with a display unit of the speed and of a value of range of the machine calculated on the basis of said speed as residual time or residual surface that can be treated by said machine before a replenishment of liquid in said reservoir.

This way, the delivery is ensured of an amount of liquid versus treated surface for achieving an optimal treatment of the surface, and for keeping the flow-rate within the minimum necessary, such that a maximum range of the machine is obtained.

Advantageously, the frame is configured to translate with respect to the surface to treat by means of wheels, and the sensor configured to provide a value proportional to a translation speed of the machine is an encoder arranged to measure the speed of one of the wheels.

Alternatively, the frame is configured to translate with respect to the surface to treat operated by a motor, and the sensor configured to provide a value proportional to a translation speed of the machine is a sensor configured to measure the pulse-width modulation (PWM) of the motor.

Advantageously, the control unit is associated with a display unit of the operating parameters and of a value of range of the machine calculated on the basis of values calculated of the flow-rate adjusted responsive to the speed, and then of the time necessary to empty the capacity of liquid of the reservoir.

This way, the operator is enabled to see on the display unit the values of residual range of the machine, versus time, or the residual surface to treat, in order to determine the optimal route that allows to reach a replenishment point without loss of time or covering useless routes.

The adjustment element can consist of a piloted valve, and the reservoir is arranged with respect to the delivery mouth for delivering liquid to the surface treatment element by gravity through the valve.

This solution makes it possible to minimize the costs for making the machine, since it does not need a pump for delivering the liquid to the treatment element, but exploits simply the gravity, achieving the goal of avoiding the difficulty to control the amount of supplied liquid responsive to the treated surface.

Also the operator is enabled to see on the display unit the values of residual range of the machine, versus time, or the residual surface to treat, and to set in turn the treatment route that allows maximizing the range of the machine and eventually making a replenishment without loss of time or covering useless routes. In particular, the operator can set the range of the machine so that up to the replenishment point the flow-rate of liquid is constant and all the liquid present in the reservoir is used.

Advantageously, the input/output unit is associated with a display unit of the operating parameters and of a value of range of the machine calculated on the basis of instant values of the measurement of the volume of residual liquid present in the reservoir and of a flow-rate value responsive to the speed.

This way, the operator is enabled to see on the display unit the values of residual range of the machine, versus time, or the residual surface to treat, in order to determine the optimal route that allows to reach a replenishment point without loss of time or covering useless routes. In case, during the route, the operator chooses to change flow-rate value responsive to the speed, this can be done, changing thus constant the flow-rate value of dispensed treatment liquid.

In an embodiment the adjustment element is a piloted valve, and the reservoir is arranged with respect to the delivery mouth for delivering liquid to the surface treatment element by gravity through the valve.

This solution makes it possible to minimize the costs for making the machine, since it does not need a pump for delivering the liquid to the treatment element, but exploits simply the gravity, achieving the goal of avoiding the difficulty to control the amount of supplied liquid responsive to the treated surface.

Then, the operator is enabled to see on the display unit the values of residual range of the machine, versus time, or the residual surface to treat, and to set in turn the treatment route that allows maximizing the range of the machine and eventually making a replenishment without loss of time or covering useless routes.

BRIEF DESCRIPTION OF THE DRAWINGS

The invention will be now shown with the following description of an exemplary embodiment thereof, exemplifying but not limitative, with reference to the attached drawings in which.

DETAILED DESCRIPTION OF SOME EXEMPLARY EMBODIMENTS

Figure 1:
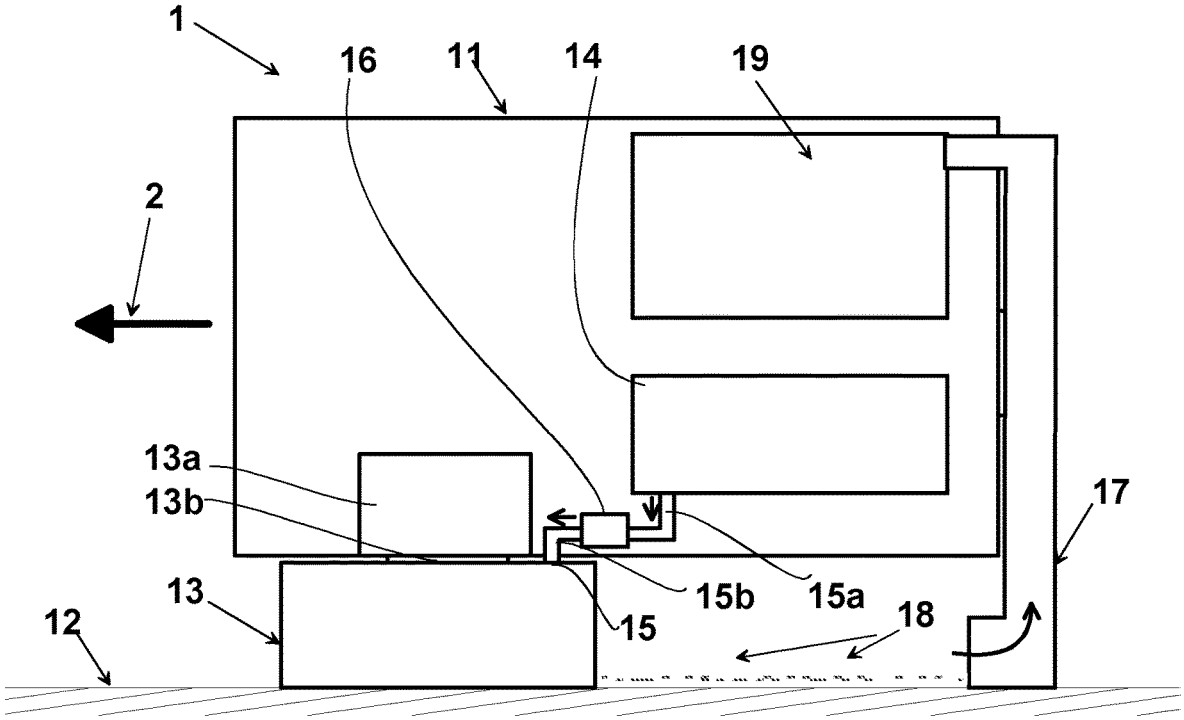
Fig. 1 (prior art)
FIG. 1 shows a block diagram of a generic surface treatment machine according to the prior art.

As shown in FIG. 1, a surface treatment machine, whose general layout is known and indicated as 1, comprises a frame 11 configured to translate with respect to a surface 12 to treat.

The translation, in the direction of arrow 2, can be carried out by pushing, through a handlebar or through separate handles (not shown), or in a motorized way, through wheels or tracks (not shown), and the machine can be of ride-on type or of walk-behind type. The surface 12 to treat can be a floor but it can also be vertical, such as the case of windows or vertical walls, with the machine moved on vertical guides or through lifting platforms (not shown).

Machine 1 comprises a surface treatment element 13, which is connected to the frame 11 and configured to treat with liquid surface 12, with respect to which the frame 11 advances.

The surface treatment element, indicated generally as block 13, can be a rotating brush or other brush element, as well as it can be a vibrating pad or other treatment element, for example a spray liquid distributor. A motor can be provided or other actuating element 13*a* for actuating a connecting element 13*b* linked to the surface treatment element 13, for example a rotating shaft.

Furthermore, machine 1 comprises a reservoir 14 connected to the frame 11 and arranged to supply a liquid to surface treatment element 13 through a delivery mouth 15. It is then provided an adjustment element 16 arranged to feed adjustably the liquid supplied from reservoir 14 to delivery mouth 15, and located between two branches 15*a* and 15*b* arranged for feeding the liquid from reservoir 14 to delivery mouth 15.

The treatment liquid in reservoir 14 can be water, water with detergent, pure detergent, or other treatment liquid, for example protecting film, coating film, etc. A further reservoir can also be provided which can contain a detergent to mix with water before the delivery (not shown).

The adjustment element indicated generally with block 16 can be a valve or a pump. It can be simply an On/Off device or an adjustable device, for example an adjustable tap valve.

In FIG. 1 a collection element 17 is also shown, for example a squegee associated with a suction device, which is arranged to drain, as machine 1 progressively moves in the direction of arrow 2, the surplus treatment liquid 18 that soaks surface 12. Collection element 17 is connected hydraulically to a container 19 arranged for collecting residual liquid and possible dirt.

Collection element 17 can also be missing in certain models of machine.

In the rear zone of the machine wheels can be provided, not shown, driven or idle, both in the presence of collection element and without it.

Figure 2:
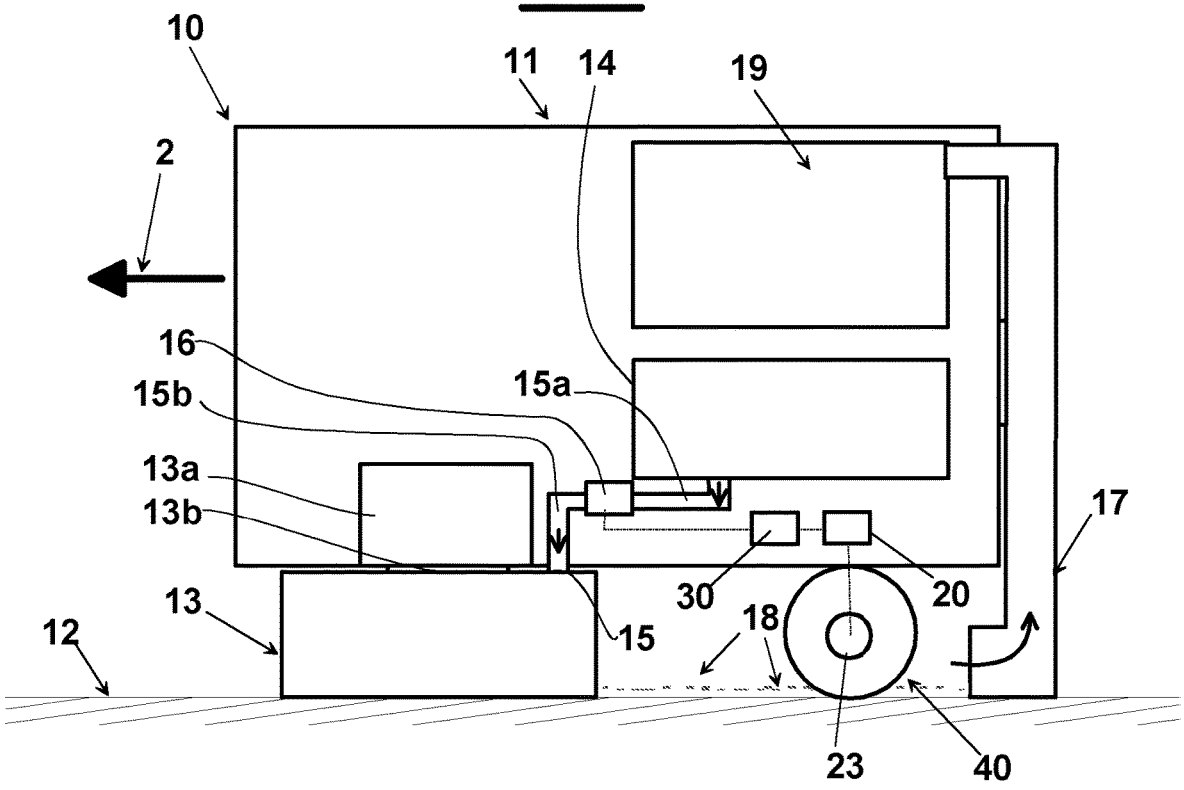
FIG. 2 shows a block diagram of a generic surface treatment machine according to the invention.

As shown in FIG. 2, according to the present invention, a surface treatment machine 10, starting from surface treatment machine 1 of FIG. 1, is modified in order to comprise an adjustment element 16 arranged to feed adjustably the liquid supplied by reservoir 14 to the delivery mouth. Adjustment element 16 can be, for example, an electrically operated adjustment valve, or an electric pump with adjustable speed.

Furthermore, it comprises a speed sensor 20 configured to measure the translation speed of the machine relatively to surface 12.

A control unit 30 is provided arranged to receive from sensor 20 a signal proportional to the speed. In particular, control unit 30 comprises program means 80, such as a microcontroller, configured to set adjustment element 16 responsive to this speed. More in particular, control unit 30 is programmed for adjusting adjustment element 16 in case the speed is different from predetermined values.

In particular, control unit 30 receives by sensor 20 the signal proportional to a speed and then compares it with the predetermined values.

In this case, adjustment element 16 can be a piloted valve, where control unit 30 is configured to adjust an opening rate of the valve in an increasing way responsive to an increase of the speed determined by sensor 20.

Alternatively, adjustment element 16 can be a pump, where control unit 30 is configured to adjust the speed of the pump in an increasing way responsive to an increase of the speed.

In the control unit for example, a servo-assistance function of adjustment element 16 can be recorded, which is configured to cause an adjustment of the flow-rate responsive to an increase of the speed, increasing responsively the opening rate of the valve or the number of turns of the pump.

As shown in FIG. 2, the frame 11 is configured to translate with respect to surface 12 to treat by means of wheels 40, and sensor 23, which is configured to provide a value proportional to a translation speed of the machine, can be an encoder arranged to measure the speed of one of wheels 40.

For example, the higher the speed, the higher the values of the adjustment parameter, in order to keep constant the amount of supplied liquid versus treated surface.

The translation can be carried out by pushing the frame or in a motorized way. Such solution with encoder 23 on one of wheels 40 adjusts precisely the delivery of the treatment liquid even with translation by pushing, which can be particularly irregular, since, with respect to a driven translation, the operator can keep in a difficult way a constant value of the speed.

Figure 3:
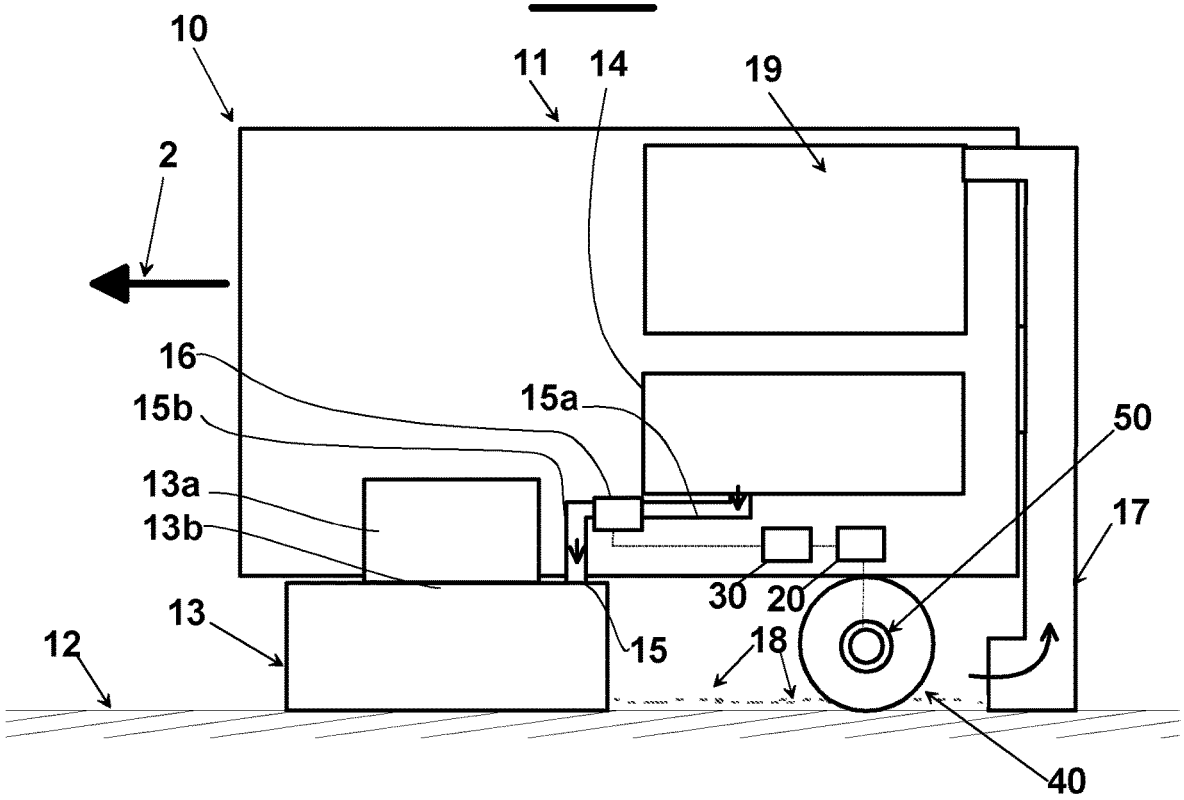
FIG. 3 shows a block diagram of an exemplary embodiment of a generic surface treatment machine according to the invention.
Figure 4:
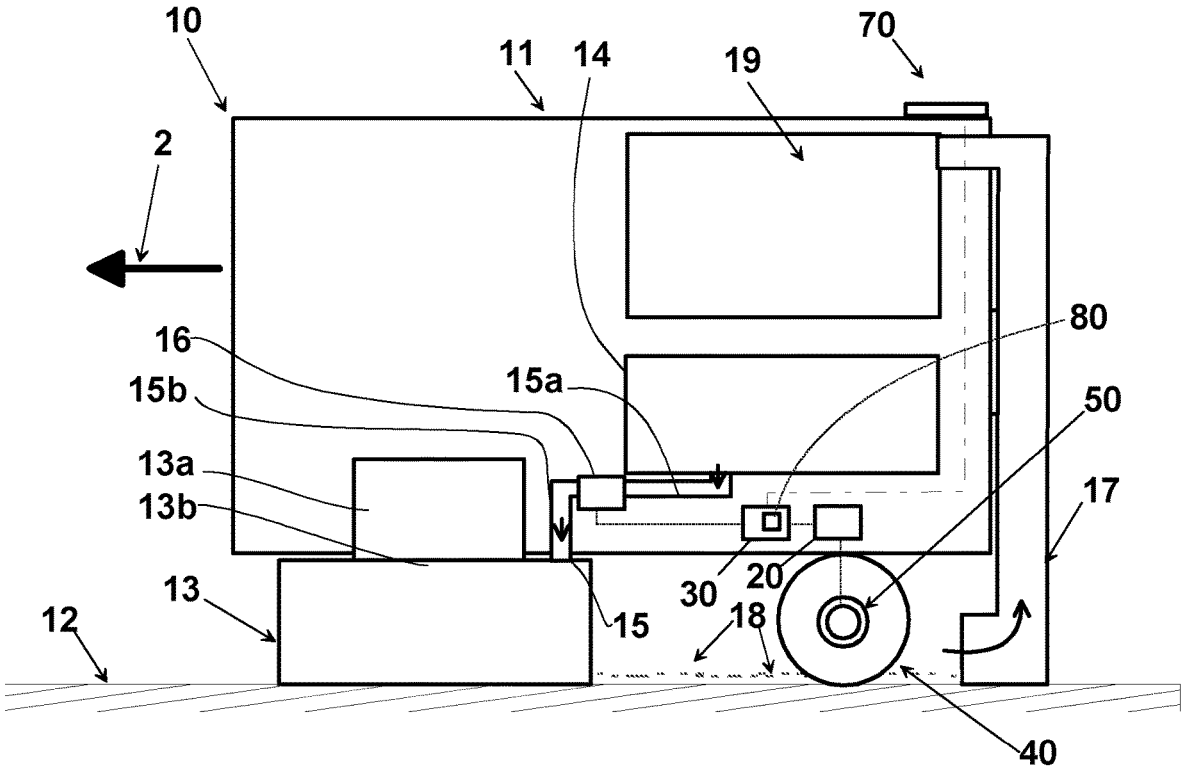
FIG. 4 shows an exemplary embodiment of the surface treatment machine of FIG. 3, with the addition of a input/output unit, with possible display unit.

In case of motorized translation, as diagrammatically shown in FIG. 3, the frame 11 is configured to translate with respect to surface 12 to treat operated by a motor 50. Alternatively to the encoder described of FIG. 2, the sensor, in the case of FIG. 6 can be an amperometric sensor 24 arranged to measure, as parameter proportional to the speed, the pulse-width modulation (PWM) of the motor 50. Even in this case, the higher the driving current, function f(P3), in the form of table or analytical function, the higher the values of the adjustment parameter, in order to keep constant the amount of supplied liquid versus treated surface.

Figure 5:
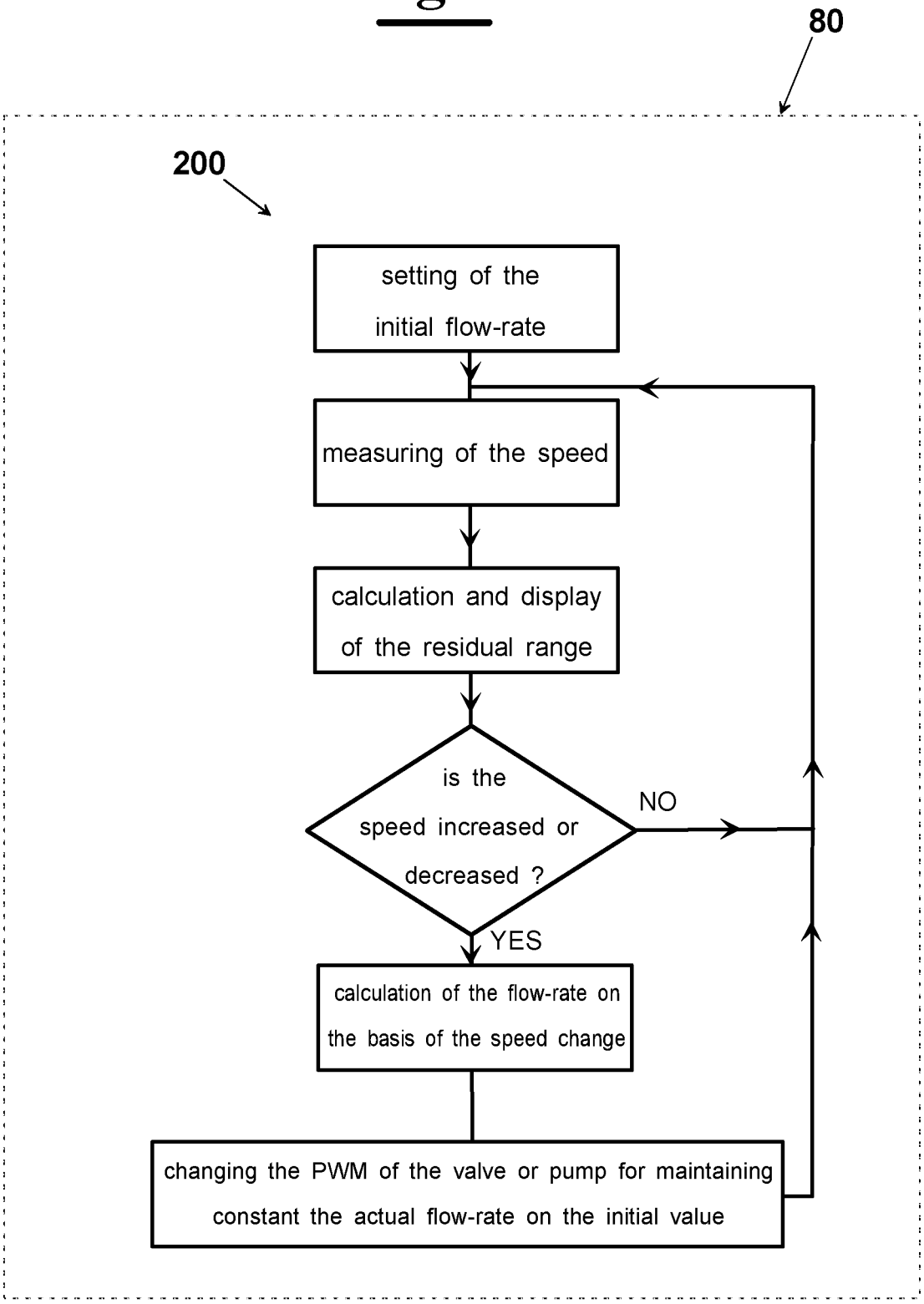
FIG. 5 shows a possible flow-sheet of the program means resident in the control unit of the machine.

In FIG. 5 a flow-sheet 200 is shown in which, owing to the main phases made by the program means 80 resident in control unit 30 of machine 1 for adjusting adjustment element 16, a flow-rate of liquid is supplied in an increasing way responsive to an increase of the speed optimizing the flow-rate, in order to achieve a maximum range of the machine.

The foregoing description of specific exemplary embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A surface treatment machine, comprising:

a frame configured to translate with respect to a surface to treat;

a surface treatment element connected to said frame and configured to treat with a treatment liquid a surface with respect to which said frame advances;

a reservoir connected to said frame and arranged to supply the treatment liquid to said surface treatment element through a delivery mouth;

an adjustment element arranged to adjustably feed the treatment liquid provided by said reservoir to said delivery mouth;

a sensor configured to measure a value of translation speed of the frame with respect to the surface to treat and to provide a signal proportional to the value of translation speed measured by the sensor;

a control unit comprising a microcontroller and arranged to receive from said sensor said signal proportional to the value of translation speed measured by the sensor;

the control unit configured to set adjust the adjustment element if the value of translation speed measured by the sensor is different from predetermined values, the control unit being arranged to adjust the adjustment element for supplying a flow-rate of liquid in an increasing way responsive to an increase of the value of translation speed measured by the sensor, in order to achieve a maximum range of the surface treatment machine;

wherein said control unit is associated with a display unit for displaying said translation speed and a value of range of the surface treatment machine determined on the basis of instant values of the measurement of a volume of residual liquid present in the reservoir and of a flow rate value responsive to the value of translation speed measured by the sensor for calculating the value of range of the surface treatment machine as residual time or residual surface that can be treated by said surface treatment machine before a replenishment of liquid in said reservoir.

2. Surface treatment machine according to claim 1, wherein said adjustment element is selected from the group consisting of:

a piloted valve, wherein said control unit is configured to adjust the opening of said valve in an increasing way responsive to an increase of the value of translation speed measured by the sensor;

a pump with an adjustable speed, wherein said control unit is configured to adjust the adjustable speed of said pump in an increasing way responsive to an increase of the value of translation speed measured by the sensor.

3. Surface treatment machine according to claim 1, wherein said frame is provided with a plurality of wheels for translating the frame with respect to said surface to treat, and wherein said sensor is an encoder arranged to measure a value of translation speed of one of said plurality of wheels.

4. Surface treatment machine according to claim 1, wherein said frame is provided with a plurality of wheels operated by a motor for translating the frame with respect to said surface to treat, and wherein said sensor is arranged to measure a pulse-width modulation (PWM) of said motor.

5. A method of treatment of surfaces, comprising the steps of:

translating a surface treatment machine with respect to a surface to treat, said surface treatment machine having a surface treatment element connected to a frame;

feeding, at said surface treatment element, a treatment liquid, so that said surface treatment element treats with said liquid said surface during said translating;

said treatment liquid being drawn from a reservoir connected to said frame, in order to provide said treatment liquid to said surface treatment element through a delivery mouth;

said method further comprising the steps of:

measuring by a sensor a value of translation speed of the frame with respect to the surface to treat;

adjusting said delivery of treatment liquid provided by said reservoir to said delivery mouth if the value of translation speed measured by the sensor is different from predetermined values;

wherein said adjusting provides to supply a flow-rate of treatment liquid in an increasing way responsive to an increase in the value of translation speed measured by the sensor, in order to achieve a maximum range of the surface treatment machine;

calculating a value of range of the surface treatment machine determined on the basis of instant values of the measurement of the volume of residual liquid present in the reservoir and of the flow-rate value responsive to said value of translation speed measured by the sensor, the value of range of the surface treatment machine being calculated as residual time or residual surface that can be treated by said surface treatment machine before a replenishment of liquid in the reservoir;

displaying, by a display unit, said value of translation speed measured by the sensor and the calculated value of range of the surface treatment machine.

* * * * *